United States Patent [19]

Johnson, III

[11] Patent Number: 4,980,941

[45] Date of Patent: Jan. 1, 1991

[54] FITTED BEDDING PRODUCT WITH STRETCH WALL CONSTRUCTION

[75] Inventor: C. Albert Johnson, III, Albemarle, N.C.

[73] Assignee: Perfect Fit Industries, Inc., Monroe, N.C.

[21] Appl. No.: 427,664

[22] Filed: Oct. 26, 1989

[51] Int. Cl.[5] ..... A47G 9/02

[52] U.S. Cl. ..... 5/497; 5/499

[58] Field of Search ..... 5/494–499

[56] References Cited

U.S. PATENT DOCUMENTS

| | | | |
|---|---|---|---|
| 1,748,743 | 2/1930 | Wedler . | |
| 1,771,872 | 7/1930 | Brock et al. . | |
| 2,195,039 | 3/1940 | Shauer | 5/497 |
| 2,414,927 | 1/1947 | Chapman . | |
| 2,624,893 | 1/1953 | Harris | 5/497 |
| 2,942,280 | 6/1960 | May, Jr. . | |
| 3,013,283 | 12/1961 | Steffinch | 5/497 |
| 3,290,702 | 12/1966 | Seltzer . | |
| 3,670,345 | 6/1072 | Doll et al. . | |
| 3,795,019 | 8/1974 | Fragas | 5/497 X |
| 4,042,986 | 8/1977 | Goodman et al. . | |
| 4,651,370 | 3/1977 | Vitale | 5/497 |
| 4,672,702 | 6/1987 | Isham | 5/497 |
| 4,682,379 | 7/1987 | Dugan | 5/500 |
| 4,703,530 | 11/1987 | Gusman | 5/497 |
| 4,720,415 | 1/1988 | Vander Wielen et al. | 428/152 |
| 4,781,966 | 11/1988 | Taylor | 428/152 |
| 4,801,482 | 1/1989 | Goggans et al. | 428/68 |

FOREIGN PATENT DOCUMENTS

| | | |
|---|---|---|
| 926706 | 6/1963 | United Kingdom . |
| 933420 | 8/1963 | United Kingdom . |
| 1012503 | 12/1965 | United Kingdom . |

*Primary Examiner*—Michael F. Trettel

*Attorney, Agent, or Firm*—Seidel, Gonda, Lavorgna & Monaco

[57] ABSTRACT

A fitted sheet is adapted to fit conformingly over a mattress. The fitted sheet comprises a top panel having a general shape and size similar to that of the top surface of the mattress. Side panels depend from the edges of the top panel. Portions of the side panels are made of an elastic material, each elastic portion extending from the bottom hem of the side panels to the top panel.

2 Claims, 2 Drawing Sheets

FIG. 2

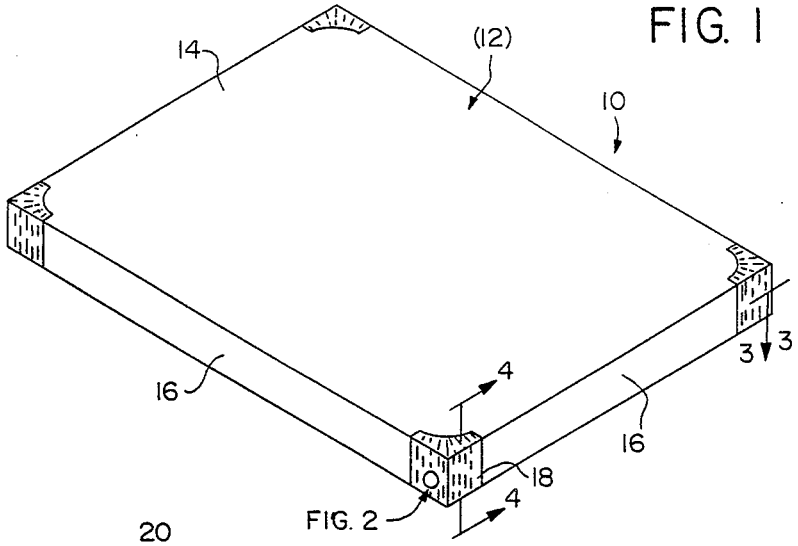
FIG. 1
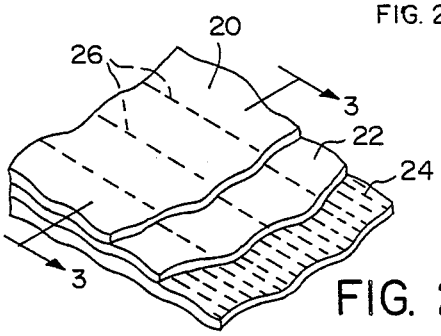
FIG. 2
FIG. 4
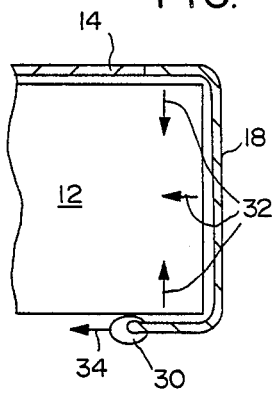
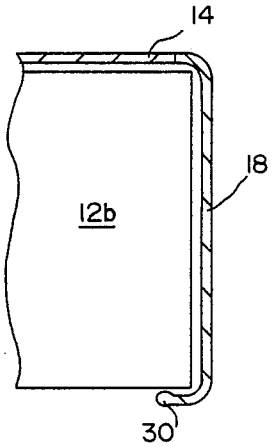
FIG. 5B
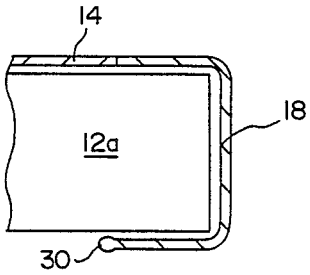
FIG. 5A FIG. 3
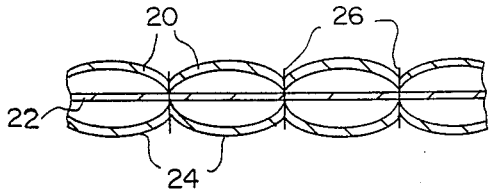
FIG. 7
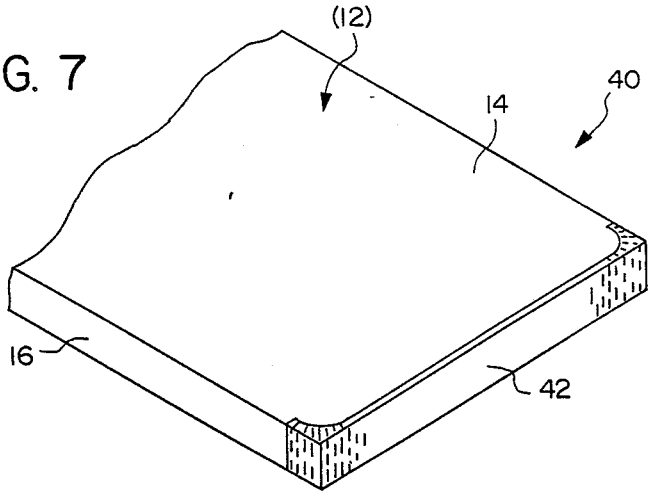
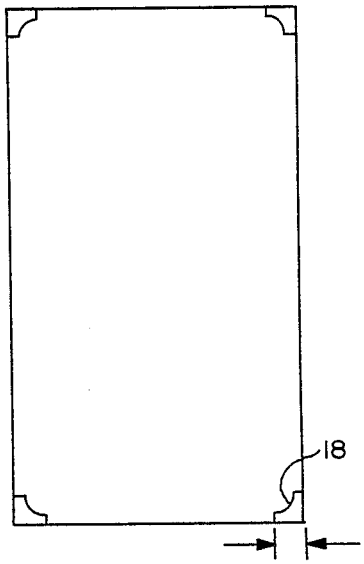
FIG. 6A
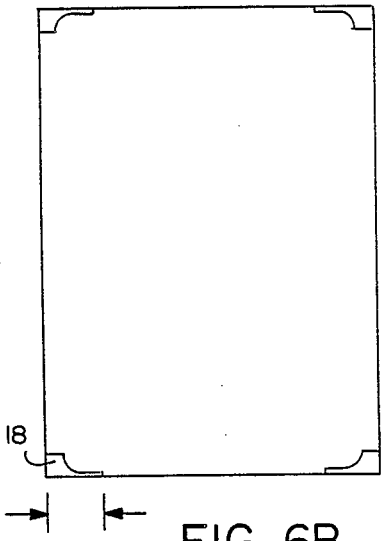
FIG. 6B

FITTED BEDDING PRODUCT WITH STRETCH WALL CONSTRUCTION

FIELD OF THE INVENTION

The present invention relates to a bedding product having elastic means to enable it to fit conformingly over a mattress.

BACKGROUND OF THE INVENTION

The fitted sheet is an item of bed clothing which is adapted to conform to the shape of a mattress so that the sheet fits snugly and neatly in place. A typical fitted sheet comprises a top panel covering the top surface of the mattress, and side panels which fit over the sides of the mattress, in some cases extending to the bottom surface of the mattress as well. Typically, fitted sheets have seams joining the corners formed by the side panels, so that the fitted sheet is in the general shape of an open box surrounding the top and side surfaces of the mattress.

Fitted sheets tend to become dislodged from the mattress because of the normal motions of a sleeper on the bed, and so usually include elastic for securing the fitted sheet on the mattress. Typical arrangements include an elastic band disposed around the hem formed by the side panels where they extend under the mattress. However, it has been found that the use of an elastic band by itself is generally not satisfactory for securing the fitted sheet to the mattress. Further, even within a recognized size category of mattresses (e.g., "twin," "full," "king"), there may be a significant variation in length, width, and thickness among mattresses made by various manufacturers. If the fitted sheet does not closely conform to the proportions of a particular mattress, the tendency of the fitted sheet to be dislodged is increased.

It is an object of the present invention to provide a fitted sheet which overcomes the above-mentioned problems associated with fitted sheets.

SUMMARY OF THE INVENTION

The present invention is a fitted sheet adapted to conformingly fit over a mattress. The fitted sheet comprises a non-elastic top panel having a general shape similar to that of the top surface of the mattress. The edges of the top panel define a plurality of sides and a plurality of corners. Depending from the edges of the top panel are side panels which are adapted to extend around the side surfaces of the mattress. At least a portion of the side panels is made of an elastic material. The elastic extends from the bottom of the side panels to the top panel.

In a preferred embodiment of the present invention, the elastic material comprises a layer of fabric, a layer of a non-woven elastic material, and a layer of backing material, with the elastic layer between the fabric and backing material. The three layers are bonded together, preferably but not necessarily by a plurality of seams. The non-elastic first and third layers are bunched between the seams to allow the three layer structure to stretch in two directions.

Also in the preferred embodiment of the invention, the elastic portions of the side panels are disposed near the corners of the mattress. Alternatively, the invention may be embodied in a form in which the elastic portions encompass the corners and two opposing side panels of the fitted sheet. The remainder of the side panels in both embodiments are preferably made of the same non-elastic material that forms the top panel.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric view of a fitted bedding product of the present invention in place on a mattress.

FIG. 2 is a detailed cut-away view of a portion of the product of FIG. 1 showing the structure of the elastic portion of the side panels.

FIG. 3 is a cross-sectional view of the elastic portion of the side panels, taken along line 3—3 of FIG. 1.

FIG. 4 is a cross-sectional view of the elastic portion of the side panels in place around a mattress.

FIGS. *5a* and *5b* are comparative cross-sectional views of the elastic portion of the side panels, disposed around mattresses of different thicknesses.

FIGS. *6a* and *6b* are comparative top views of the fitted bedding product of the present invention, disposed around mattresses of different proportions.

FIG. 7 is an isometric view of an alternate embodiment of the present invention in place on a mattress.

DETAILED DESCRIPTION OF THE INVENTION

FIG. 1 shows the fitted bedding product 10 of the present invention disposed around a mattress 12, which is not directly visible in FIG. 1. The fitted bedding product 10, which may but need not be a sheet, comprises a top panel 14 which generally conforms in shape and size to the top surface of mattress 12, although preferably top panel 14 will be somewhat smaller than the top surface of mattress 12. Depending from the side edges of top panel 14 are four side panels 16, two of which are visible in the drawing. The side panels 16 together form a bottom hem at their edges. The side panels 16 may be sewn to top panel 14 by a seam, or top panel 14 and side panels 16 may be formed from a single piece of fabric. The top panel 14 and side panels 16 are preferably made of a non-elastic woven fabric which may be comfortably slept upon, such as but not limited to linen or flannel.

At the corners formed by the junctions of side panels 16 are elastic portions 18. Each elastic portion extends from the bottom hem formed by the side panels 16 toward the top panel 14. Each elastic portion 18 is of such a size as to accommodate the thickness of the thickest mattress likely to be covered by the sheet.

FIG. 2 is a detailed view showing the preferred structure of each elastic portion 18. The elastic portions 18 are preferably a laminate having a three-layer structure. Layer 20, which is outermost when fitted sheet 10 is in place on a mattress, is preferably made of a woven bedding material, such as but not limited to linen or flannel, and preferably is of the same material as top panel 14. Just beneath layer 20 is an intermediate layer 22, which is made of a non-woven elastic material. A material particularly well-suited for intermediate layer 22 is described in U.S. Pat. No. 4,720,415. Of course, the present invention does not require intermediate layer 22 to be of any particular material. All that is important is that intermediate layer 22 be elastic in two directions. Below layer 22 is a backing layer 24, which may be made of a woven material similar to that of layer 20, or preferably may be made of a non-woven material having a pattern of small perforations, which is known in the bedding art. The three layers are bonded together, preferably although not necessarily by a series of parallel seams 26.

FIG. 3 is a cross-sectional view of the three layers of elastic portions 18, showing how the non-elastic layers 20 and 24 are preferably bunched between the seams 26, so that stretching of the elastic middle layer 22 can be accommodated. The bunching of layers 20 and 24 is both parallel and perpendicular to the seams 26, so that the three layers may together be stretched in two directions.

FIG. 4 shows the arrangement of the elastic portions 18 when the fitted sheet 10 is arranged around a mattress 12. Because elastic portion 18 is elastic throughout its area, elastic portion 18 will surround not only the side of the mattress 12 but the edges of the top and bottom of the mattress 12 as well. The fitted sheet of the present invention may further comprise an elastic band 30 attached to the bottom hem 17 of the side panels 16 and extending along the length of the bottom hem, including the non-elastic portions 16. Elastic band 30 may be sewn into the fabric along the edge of the bottom hem, or may be folded into the fabric.

FIG. 4 shows how each elastic portion 18 creates an elastic force towards the center of the mattress along the sides and top and bottom of the mattress 12. This force is shown by vector arrows 32. Further, the elastic band 30 running the length of the bottom hem 17 of the side panels 16 tends to pull the bottom hem inward, as shown by vector arrow 34. The combination of the elasticity throughout the area of elastic portion 18 and the elastic band 30 helps to secure the fitted sheet 10 on the mattress 12.

FIGS. 5*a* and 5*b* are comparative views of the fitted sheet 10 in place on relatively thin and thick mattresses, respectively. On thin mattress 12*a*, relatively large areas of the elastic portion 18 are disposed on the top and bottom of the mattress 12*a*. With thick mattress 12*b*, shown in FIG. 5*b*, most of the length of elastic portion 18 is surrounding the side of the mattress 12*b*. Whatever the thickness of the mattress, the fitted sheet 10 is able to conform to the unique dimensions of the mattress and still maintain a secure elastic grip on the mattress.

FIGS. 6*a* and 6*b* are comparative views of the fitted sheet of the present invention on two mattresses of different proportions of length and width. In the shorter, wider mattress shown in 6*b*, a larger proportion of each of the corner elastic panels 18 surround the end surfaces of the mattress. This comparison shows how the fitted sheet of the present invention can conform to fit around mattresses of varying dimensions within the same general size category.

FIG. 7 shows an alternate embodiment of the present invention, in which the elastic portion 18, instead of being disposed only at the corners formed by the fitted sheet, is in the form of a larger elastic panel 42 which encompasses two corners and an entire side of the mattress. Typically, two such panels 42, disposed at opposite ends of a mattress, would be used. This arrangement provides even greater securing of the fitted sheet to the mattress, and can be used on a wider range of mattress sizes.

The present invention may be embodied in other specific forms without departing from the spirit or essential attributes thereof and, accordingly, reference should be made to the appended claims, rather than to the foregoing specification, as indicating the scope of the invention.

I claim:

1. A bedding product adapted to fit conformingly over a mattress, comprising:

a non-elastic top panel having a shape and size generally similar to that of the top surface of the mattress and having a plurality of side edges and a plurality of corners;

a plurality of elastic panels attached to respective edges of the top panel near each corner of the top panel and adapted to conform to the shape of the corner surfaces of the mattress, the elastic panels including a layer of woven bedding fabric, a layer of backing material, and a layer of non-woven elastic material therebetween, the layers being joined together by a network of seams, the fabric layer and backing layer being bunched between the seams whereby the side panels are stretchable in at least one direction;

a plurality of non-elastic side panels attached to the edges of the top panel along respective sides of the top panel and attached to the elastic panels at each corner of the top panel, the side panels and elastic panels forming a common edge; and an elastic band disposed generally along the common edge of the side panels and elastic panels.

2. A fitted sheet adapted to fit conformingly over a mattress, comprising:

a non-elastic top panel having a shape and size generally similar to that of the top surface of the mattress and having a plurality of side edges and a plurality of corners; two elastic panels attached to respective edges of the top panel, each elastic panel encompassing two corners of the fitted sheet and substantially all the area between the two corners along two opposing side panels, each elastic panel including an outermost layer of woven bedding fabric, a second layer of a non-woven elastic materials, and an innermost layer of backing material, the three layers being bonded together by a network of seams and the outermost and innermost layers being bunched between the seams whereby the elastic panels are stretchable in at least one direction;

two non-elastic side panels attached to the edges of the top panel along opposite sides of the top panel adjacent to the sides of the top panel attached to the elastic panels and attached to the elastic panels near each corner of the top panel, the side panels and elastic panels forming a common edge and adapted to extend over the sides of the mattress to the underside of the mattress; and an elastic band disposed generally along the common edge of the side panels and elastic panels.

* * * * *